US007604107B2

(12) United States Patent
Richard et al.

(10) Patent No.: US 7,604,107 B2
(45) Date of Patent: Oct. 20, 2009

(54) SECURE COIN-OPERATED MACHINE

(75) Inventors: Thierry Richard, Besançon (FR); Jean Escalier, Montfaucon (FR)

(73) Assignee: Parkeon, Paris (FR)

( * ) Notice: Subject to any disclaimer, the term of this patent is extended or adjusted under 35 U.S.C. 154(b) by 0 days.

(21) Appl. No.: 10/432,297

(22) PCT Filed: Nov. 28, 2001

(86) PCT No.: PCT/IB01/02216

§ 371 (c)(1),
(2), (4) Date: May 21, 2003

(87) PCT Pub. No.: WO02/45036

PCT Pub. Date: Jun. 6, 2002

(65) Prior Publication Data

US 2004/0031661 A1 Feb. 19, 2004

(30) Foreign Application Priority Data

Nov. 30, 2000 (FR) ..... 00 15633

(51) Int. Cl.
*G07F 1/00* (2006.01)

(52) U.S. Cl. ..... 194/351; 194/350; 232/15; 232/16; 232/44; 232/551; 193/DIG. 1

(58) Field of Classification Search ..... 232/55, 232/58–60, 7, 9–12, 14, 44, 15, 16; 194/350, 194/351, 200–202; 206/0.8–0.84
See application file for complete search history.

(56) References Cited

U.S. PATENT DOCUMENTS

| | | | | |
|---|---|---|---|---|
| 3,083,896 | A * | 4/1963 | Cairelli et al. | 232/15 |
| 3,807,627 | A | 4/1974 | Nitschneider | 232/15 |
| 4,289,269 | A * | 9/1981 | Sciortino | 232/16 |
| 4,359,184 | A * | 11/1982 | Sciortino | 232/16 |
| 4,372,479 | A * | 2/1983 | Sciortino | 232/15 |
| 4,456,165 | A * | 6/1984 | Sciortino | 232/15 |
| 4,471,905 | A * | 9/1984 | Sloma et al. | 232/15 |
| 4,545,475 | A * | 10/1985 | Fillod et al. | 194/350 |
| 4,795,087 | A * | 1/1989 | Procak | 232/7 |
| 5,725,081 | A * | 3/1998 | Meeker | 194/206 |
| 6,318,537 | B1 * | 11/2001 | Jones et al. | 194/346 |
| 6,571,931 | B2 * | 6/2003 | Oden | 194/350 |
| 6,658,323 | B2 * | 12/2003 | Tedesco et al. | 700/236 |

FOREIGN PATENT DOCUMENTS

| | | | |
|---|---|---|---|
| EP | 0561579 | A2 * | 9/1993 |
| EP | 0 571 188 | B1 | 1/1997 |
| GB | 755636 | | 8/1956 |

* cited by examiner

*Primary Examiner*—Jeffrey A Shapiro
(74) *Attorney, Agent, or Firm*—Osha • Liang LLP

(57) ABSTRACT

The invention concerns a service and/or product dispensing apparatus comprising a coin-receiving device, a coin-storage box (5) and said chute (7) transferring coins from the receiving device to the box (5). The invention is characterised in that said chute (7) co-operates with a closing device (8) comprising a trap (82) mobile between a position closing and a position opening said chute (7), said device (8) co-operating with control means (40) adapted to trigger the displacement of the trap (82) into its closing position when at least part of the coin-receiving device (4) is being dismantled.

11 Claims, 3 Drawing Sheets

SECURE COIN-OPERATED MACHINE

FIELD OF THE INVENTION

This invention concerns coin-operated machines used to dispense products or services such as Pay & Display parking machines or pay telephones. This invention is particularly aimed at protecting the coins stored in such machines from theft.

BACKGROUD OF THE INVENTION

In general, coin-operated machines comprise a receiving mechanism that enables the issuing of a service or product in return for the payment of the corresponding amount in coins. Such mechanisms contain the entire path of the coins, which are chiefly moved by gravity from the inlet formed by the coin insertion slot and the two outlets placed below the said inlet, namely a bowl for returning unused or unsuitable coins and a box for the received coins. Between the inlet and outlet are placed means to authenticate the coins inserted and escrow means designed for storing valid coins temporarily.

In general, such machines include two distinct compartments closed by distinct doors, where the first one includes the various mechanisms required for machine operation and particularly the means to authenticate the coins and store them temporarily and the second one contains the coin box and is more secure than the first one.

It is well known that coin-operated machines attract fraudulent users, who try their best to get to the cash.

One of the fairly frequent forms of fraud consists in getting to the coins in the box by opening the first compartment and using the downward coin path that connects the escrow means and the box, after removing the said escrow means.

This invention is aimed at limiting such fraud.

SUMMARY OF THE INVENTION

The coin-operated machine that dispenses services and/or products in accordance with the invention includes a coin receiving mechanism, a box for storing the coins and a chute for transferring the coins from the receiving mechanism to the box.

According to the invention, the coin-operated machine is characterised in that the coin chute cooperates with a closing device comprising a mobile trap between a position opening and a position closing the chute, which device cooperates with control means that can trigger the sudden displacement of the trap to the closing position if any part of the coin receiving mechanism is dismantled.

Another characteristic of the coin-operated machine according to the invention is that the closing mechanism contains a ratchet locking system, where the locking system is designed to lock the trap in the position that closes the coin chute.

Another characteristic of the coin-operated machine according to the invention is that the receiving mechanism is placed in the first compartment and the coin box is located in the second compartment, the compartments being separated by a wall crossed by a channel that forms the coin chute.

Another characteristic of the coin-operated machine according to the invention is that the closing mechanism is located in the second compartment.

Another characteristic of the coin-operated machine according to the invention is that the ratchet locking mechanism cooperates with a manual unlocking mechanism placed in the second compartment.

Another characteristic of the coin-operated machine according to the invention is that the unlocking mechanism comprises a handle that extends to the rear of the box.

Another characteristic of the coin-operated machine according to the invention is that the trap is carried by an arm fitted to rotate at one axial end, whereas the other axial end carries stop surfaces designed to cooperate with the ratchet locking mechanism. The arm cooperates with elastic return means that force the trap into the closing position.

Another characteristic of the coin-operated machine according to the invention is that the trap is held in the opening position against the opposite action of the elastic return means by the presence of control means. The removal of the control means suddenly displaces the trap to the closed position.

Another characteristic of the coin-operated machine according to the invention is that the control means that trigger the displacement of the trap to the closing position are formed by a finger carried by the lower part of the coin receiving system opposite the chute channel, which finger is adapted to penetrate into the channel when the said lower part of the receiving system is in place in its compartment, so as to prevent the movement of the trap to the closing position.

Another characteristic of the coin-operated machine according to the invention is that the closing device is fitted on a bearing structure above the box.

BRIEF DESCRIPTION OF THE DRAWINGS

The aims, aspects and benefits of this invention will be easier to understand from the description below of a mode of embodiment of the invention, presented as a non-limitative example by reference to the drawings attached, where.

In accordance with the drawings, only the elements essential to the invention have been shown.

DETAILED DESCRIPTION

Figure 1:
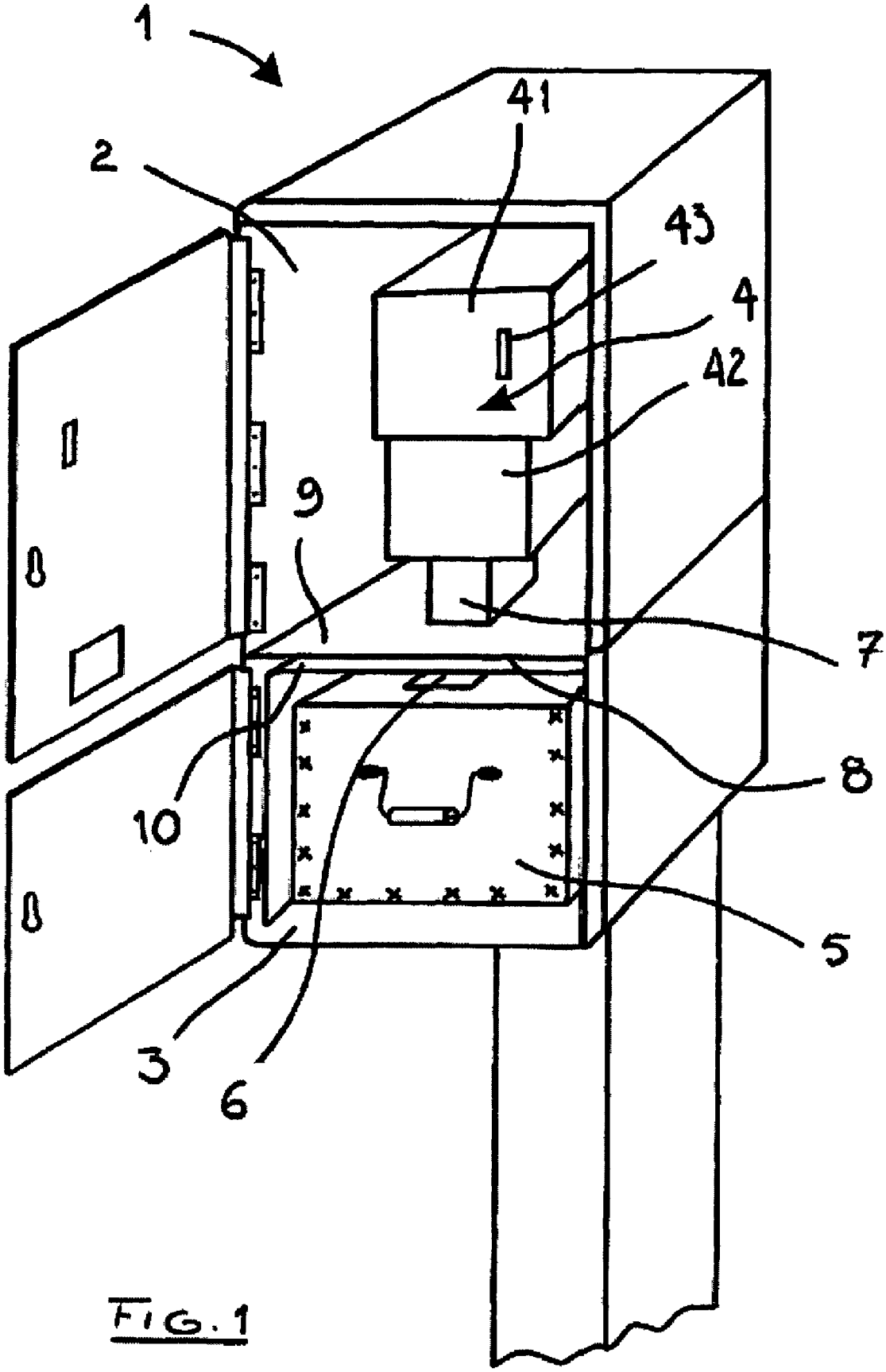
FIG. 1 is a partial schematic perspective view of a coin-operated machine according to the invention.

FIG. 1 shows a coin-operated machine that is generally designed to supply a product or service in exchange for the payment of a corresponding amount of money, which payment is made with coins. Such a device can for instance be a public telephone, a beverage dispenser or a ticket vending machine.

In the description below, the machine (reference 1) is a Pay & Display machine designed for the payment of parking spaces.

Pay & Display machine 1 contains two distinct compartments, 2 and 3 respectively, arranged one above the other. According to the example of the embodiment represented in FIG. 1, each compartment is accessible by means of a corresponding access door closed by an appropriate lock.

Upper compartment 2 includes all the mechanisms required for the Pay & Display machine to operate. The different means themselves are known and do not call for a more detailed description. compartment 2 also includes the coin receiving device 4.

The coin receiving device 4 is essentially made up of a coin selector 41 and an escrow 42. The coin selector, which is also called CVM (Coin Validating Mechanism) has a slot 43 for inserting coins in its upper part. The task of the CVM is to determine the authenticity of coins.

That CVM 41 is capable for instance of recognising the electromagnetic signatures of coins in circulation such as that described in document EP203702 and has two outlet holes for the coins. One of the outlets is intended for nonconforming or foreign coins, whilst the second one is intended for authentic coins. The first outlet is positioned vertically to a removal channel that transfers the coins by gravity to a return compartment that is not shown, made in the lower part of the receiving device, accessible by means of a tilting flap.

The coins found to be authentic by CVM 41 drop into a pipe that takes them to the escrow device under the CVM.

The CVM determines the value of each coin going through it and sends the information in the form of a digital or analogue signal to a control device made up of a microcontroller, not shown, which is known to comprise a Central Processing Unit, a Random Access Memory, a Read-Only Memory and an Electrical Erasable Programmable Read Only Memory, analogue to digital converters and different input and output interfaces.

Depending on the coins inserted by the user and the hourly parking tariff, Pay & Display Machine 1 issues a parking ticket for the time corresponding to the amount paid and receives the amount due. The coins are transferred from the escrow system 42 to compartment 3 for storage.

Lower compartment 3, which is secure particularly in that it has reinforced walls, encloses a box 5 designed to store the coins received before they are collected.

Box 5 has an upper wall with an opening 6 for coin entry. Opening 6 is designed to be placed under coin chute 7 from receiving device 4. Channel 7 goes through wall 9 separating the two compartments 2 and 3 and opens into upper compartment 2 at the outlet of receiving device 4. In order to enable the passing of channel 7, wall 9 has a corresponding opening.

The outlet area of channel 7 opens into secure compartment 3, above box 5, cooperating with a closing device 8 fitted on a carrying structure 10 that is placed in secure compartment 3.

The assembly of closing device 8 on a special carrying structure 10 does not limit this invention, and the closing device 8 could for instance be fitted directly on wall 9.

Figure 4:
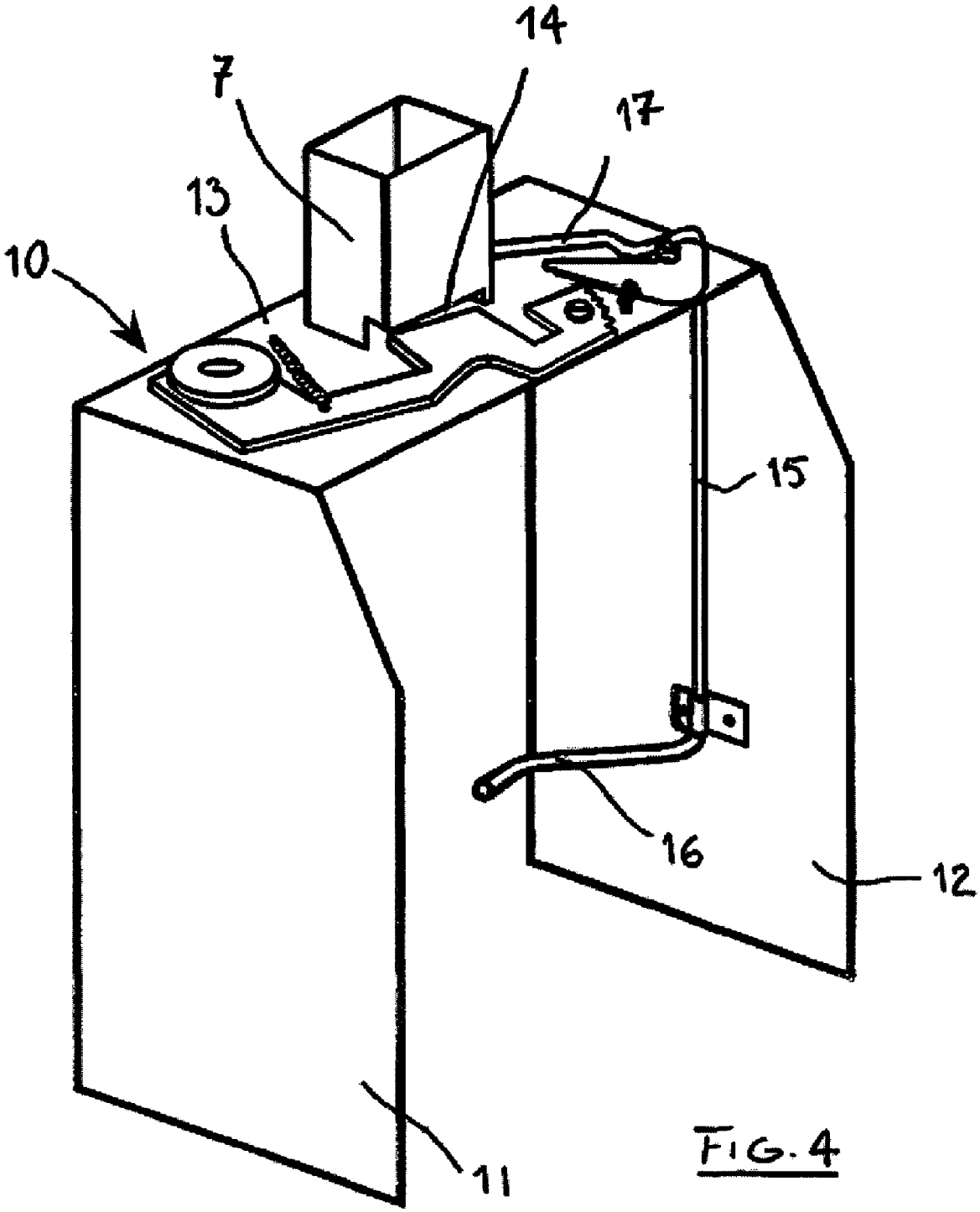
FIG. 4 is a perspective view of the structure that carries the closing device represented in FIGS. 2 and 3.

Carrying structure 10 detailed in FIG. 4 is designed to follow the internal walls of secure compartment 3 and create a false ceiling inside which the closing device is placed.

In the described example of embodiment, it includes two vertical side walls 11 and 12, which are supported by the lower wall of compartment 3 and a horizontal upper wall 13 that is designed to be located at a set distance from wall 9. The carrying structure, which is made up of the three walls welded to each other, encloses an internal hollow parallelepiped containing box 5.

If closing system 8 is fixed to wall 9, there is only one wall 13 that is fixed by pins at a set distance from wall 9.

On the upper side of wall 13, opposite wall 9, are fixed the closing device 8 and coin chute 7 which projects out above the said wall 13, to which it is fixed, e.g. by soldering. Of course, wall 13 has a hole for letting through the coins in the extension of channel 7, which hole is opposite the coin inlet hole of the box 5 when the box is placed in the said hollow parallelepiped.

Near the upper side of wall 13, the side walls that define channel 7 have a slot 14 for letting through a closing trap as detailed below by reference to FIGS. 2 and 3.

Figure 2:
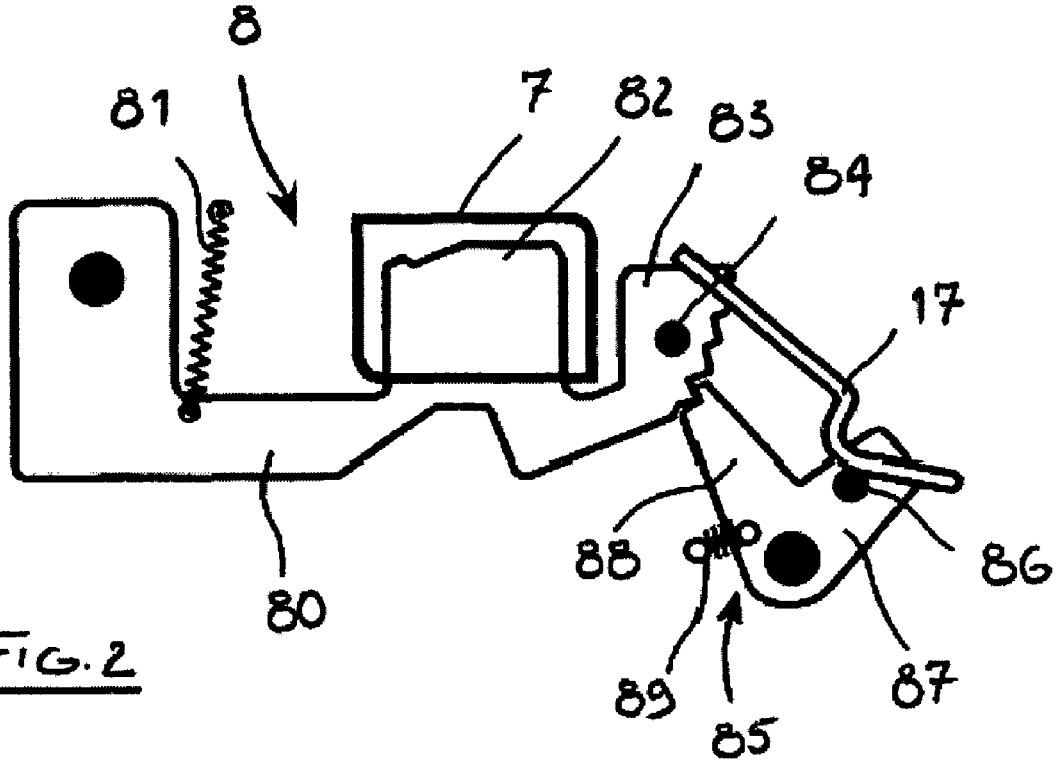
FIG. 2 is a top view of the closing system shown in FIG. 1, with the closing device in the closing position.
Figure 3:
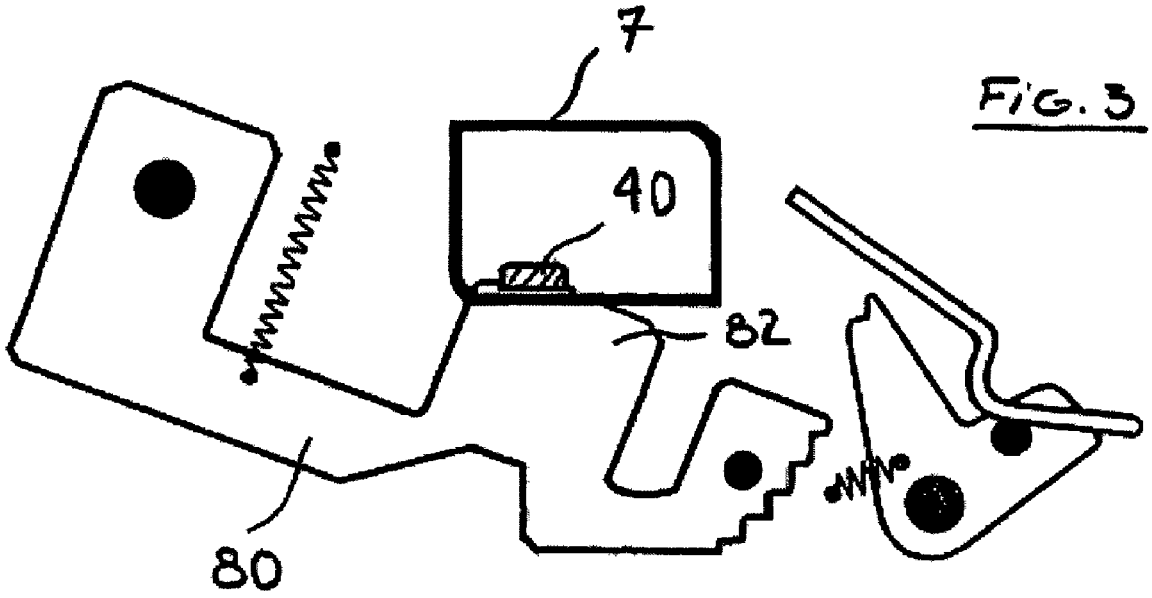
FIG. 3 is similar to FIG. 2, with the closing device in the opening position.

Closing device 8 represented on FIGS. 2 and 3 mainly comprises a flattened arm 80 fixed so that it rotates at one end around an axis extending perpendicularly to wall 13. The arm is made by cutting a metal plate of appropriate thickness and includes two extensions. The first one 82 forms a trap and is particularly formed to penetrate into slot 14 and block the interior passage of said channel 7 and a second one 83 forms a notched stop that cooperates with ratchet mechanism 85.

Arm 80 is therefore designed to rotate against the upper side of wall 13. However, a return spring 81 pulls arm 80 against channel 7, so that trap 82 penetrates into slot 14 to block the interior passage of the said channel.

The escrow system 42 includes a locking finger 40 represented in a sectional view in FIG. 3, extending from the lower end of system 42 to penetrate into channel 7 along the interior wall up to slot 14, which is blocked at least partially.

When the escrow device is in place, finger 40 is located in channel 7 behind slot 14, preventing trap 82 from penetrating into channel 7.

The closing device is then in the opening position. When the escrow system is removed from its normal operating position, finger 40 is removed from channel 7, leading to the full clearing of slot 14. Because there is no obstacle in the path of trap 82, return spring 81 pulls it so that it blocks the interior passage of channel 7 and prevents access to hole 6 of box 5 from compartment 2.

Arm 80 is kept locked in this closing position of channel 7 by a ratchet mechanism 85 which is applied against the end forming a notched stop 83 of said arm 80. Ratchet mechanism 85 is not accessible from compartment 2 and so arm 80 cannot be moved regardless of the force applied on it from upper compartment 2. End 83 has several stop surfaces that block arm 80 at different points of closing and not only when trap 82 fully blocks the interior passage of channel 7, so as to heighten security from fraud.

The ratchet mechanism acts as a non-return device which enables arm 80 to move in one direction only, that of closing channel 7.

Ratchet mechanism 85 is made up of a metal part made up of two flattened arms 87 and 88 joined in a V. The part is located close to the free end 83 of arm 80 when arm 80 is in the closing position and is fitted to rotate in its mid section around an axis extending perpendicular to wall 13. Return spring 89 tends to make the part turn so that arm 88 is behind arm 80, in contact with the notched stop surface carried by end 83 of arm 80.

In order to open closing device 8, a reset rod 15 is used, which is assembled to rotate along one of the side walls of bearing structure 10, namely wall 12.

Of course, when the said carrying structure is limited to wall 13 fixed to separating wall 9, rod 15 is then only fixed to wall 13.

That rod 15 includes a rod with two extreme parts folded more or less at right angles. The lower end forms a maneuvering rod (i.e., a hand1e) 16 and extends inside the said parallelepiped hollow and the other end 17 is located above wall 13, more or less above ratchet mechanism 85 and free end 83 of arm 80.

In the idle position when the closing system is in the open position of FIG. 2, the handle extends to the rear of box 5.

To reset the mechanism, box 5 is removed and handle 16 is pulled towards the operator so as to turn rod 15 anticlockwise, i.e. in the direction opposite the closing direction of arm 80.

Control end 17 of the rod turns in parallel and then presses against a slug 86 that projects out of arm 87 of ratchet mechanism 85. The action of the end of rod 17 on slug 86 makes arm 87 rotate and therefore arm 88 which is joined to it, against the opposite action of spring 89. That rotation of arm 88 takes place in the clockwise direction and tends to push arm 88 away from the notched stop surface of extension 83 at the end of arm 80, which is unlocked and can therefore move.

The control end 17 of the rod continues its rotation and comes in contact with a second slug 84 projecting out of arm 80 and therefore makes it rotate against the opposite action of return spring 81. That movement of arm 80 leads to the movement of trap 82, which moves out of slot 14, clearing the interior passage of channel 7.

Channel 7 being free, it is possible to reposition the receiving mechanism and push finger 40 into channel 7 up to slot 14. The locking finger being in the position where it partly blocks slot 14, the rod can be brought back in the opposite direction up to the initial idle position. Arm 80 lies in the open position and trap 82 is blocked against finger 40 due to the action of spring 81.

The rod is put back in the idle position and box 5 can be put back in place. When box 5 is in place, you can no longer move rod 15 to act on closing mechanism 8. That blocking of rod 15 by box 5 keeps the system more secure from fraud.

Of course, the invention is not limited to the embodiment described and illustrated, which is only provided as an example.

On the contrary, the invention covers all the technical equivalents of the means described and their combinations, if they are made in accordance with its spirit.

As a variant, finger 40 is elastically retractable, making it possible to put back escrow system 42 even when trap 82 blocks channel 7 opposite opening 4.

In that way, channel 7 may not be joined to wall 13, but fixed directly to separating wall 9.

The invention claimed is:

1. A machine that vends services and/or products, comprising:

a first compartment and a second compartment, wherein the first and second compartments are distinct, and wherein the first compartment is arranged above the second compartment, a wall separating the first and second compartments, a coin receiving system located in the first compartment, the coin receiving system comprising a coin selector, a pre-storage device for storing valid coins temporarily, and a pipe configured to transport coins found to be authentic by the coin selector to the pre-storage device, a locking finger fixed to the pre-storage device, a box for storing coins, located in the second compartment and comprising an opening for one or more coins, a chute that opens into the opening of the box for transferring the coins from the pre-storage device to the box through the wall, and a closing device comprising a trap, the trap being movable between an open position and a closed position of the chute, and a spring for forcing the trap into the closed position, wherein the locking finger prevents the trap from reaching the closed position, wherein removing the pre-storage device from its normal operating position removes the locking finger so that said spring forces a sudden displacement of the trap to the closed position, thereby preventing access to the opening of the box through the chute, wherein the box is placed such that the chute remains above the opening of the box during the removing of the pre-storage device.

2. The machine of claim 1, wherein the closing device has a ratchet locking system, wherein the ratchet locking system holds the mobile trap in the closed position.

3. The machine of claim 1, wherein the receiving device is located in a first compartment and the box is placed in a second compartment, and wherein the first and second compartments are separated by said wall crossed by a downward channel forming the chute.

4. The machine of claim 3, wherein the closing device is located in the second compartment.

5. The machine of claim 4, wherein the ratchet locking device cooperates with a manual unlocking device located in the second compartment.

6. The machine of claim 5, wherein the unlocking mechanism comprises a handle extending behind the box.

7. The machine of claim 4, wherein the trap is carried by an arm assembled to rotate at one axial end while the other axial end carries stop surfaces designed to cooperate with the ratchet locking device, the arm cooperating with the spring to force the trap into the closed position.

8. The machine of claim 4, wherein the closing device is fitted on a carrying structure placed above the box.

9. A machine that vends services and/or products comprising:

a first compartment and a second compartment, wherein the first and second compartments are distinct, and wherein the first compartment is arranged above the second compartment, a wall separating the first and second compartments, a coin receiving system located in the first compartment, the coin receiving system comprising a coin selected, a pre-storage device for storing valid coins temporarily, and a pipe configured to transport coins found to be authentic by the coin selector to the pre-storage device, a locking finger fixed to the pre-storage device, a box for storing coins, located in the second compartment and comprising an opening for one or more coins, a chute that opens into the opening of the box for transferring the coins from the pre-storage device to the box through the wall, and a closing device comprising a trap, the trap being movable between an open position and a closed position of the chute, and a spring for forcing the trap into the closed position, wherein the coin receiving system prevents access to the first opening of the chute, the machine farther comprising control means configured to trigger a sudden displacement of the trap to the closed position, thereby preventing access to the opening of the box through the second opening of the chute, so that there exists an access to the first opening of the chute, wherein the box is placed such that the chute remains above the opening of the box during the removing of the pre-storage device.

10. The machine of claim 9, wherein the trap is held in the open position against the opposite action of the spring by the presence of the control means, the removal of the control means leading to the sudden displacement of the trap to the closed position.

11. The machine of claim 9, wherein the control means comprises a finger carried by the lower part of the receiving device opposite the chute, the finger being designed to penetrate into the chute when the lower part of the receiving device is in position in the first compartment so as to prevent the movement of the trap to the closed position.

* * * * *